US007968152B2

(12) United States Patent
Rockenfeller et al.

(10) Patent No.: US 7,968,152 B2
(45) **Date of Patent: *Jun. 28, 2011**

(54) METHODS OF MAKING PENETRATION RESISTANT COMPOSITES

(75) Inventors: Uwe Rockenfeller, Boulder City, NV (US); Kaveh Khalili, Boulder City, NV (US)

(73) Assignee: Rocky Research, Boulder City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/689,009

(22) Filed: Jan. 18, 2010

(65) Prior Publication Data

US 2010/0119721 A1 May 13, 2010

Related U.S. Application Data

(62) Division of application No. 11/029,685, filed on Jan. 4, 2005, now Pat. No. 7,648,757.

(51) Int. Cl.
*B05D 1/04* (2006.01)
*B05D 1/18* (2006.01)

(52) U.S. Cl. ..... 427/475; 427/180; 427/427; 427/430.1

(58) Field of Classification Search ..... 427/475, 427/180, 427, 430.1
See application file for complete search history.

(56) References Cited

U.S. PATENT DOCUMENTS 4,311,630 A * 1/1982 Humphrey et al. ..... 523/215
4,351,878 A 9/1982 Harper-Tervet et al.
5,298,231 A 3/1994 Rockenfeller et al.
5,441,716 A 8/1995 Rockenfeller et al.
6,224,842 B1 5/2001 Rockenfeller et al.
6,736,194 B2 5/2004 Rockenfeller et al.
2001/0000858 A1 5/2001 Rockenfeller et al.
2006/0147710 A1 7/2006 Rockenfeller et al.

OTHER PUBLICATIONS

Restriction Requirement dated Mar. 27, 2008 in U.S. Appl. No. 11/029,686.
Office Action dated Jun. 27, 2008 in U.S. Appl. No. 11/029,686.
Department of Defense Handbook; Composite Materials Handbook, vol. 1, Ch. 3, pp. 2-3.
Final Office Action dated Dec. 12, 2008 in U.S. Appl. No. 11/029,686.
Advisory Action dated Feb. 25, 2009 in U.S. Appl. No. 11/029,686.
Office Action dated May 15, 2009 in U.S. Appl. No. 11/029,686.

* cited by examiner

*Primary Examiner* — Frederick J Parker
(74) *Attorney, Agent, or Firm* — Knobbe, Martens, Olson & Bear LLP

(57) ABSTRACT

A penetration resistant composite comprises a substrate material comprising woven, layered or intertwined polarized strands of glass, polyamide, polyphenylene sulfide, carbon or graphite fibers, a salt, oxide, hydroxide or hydride of a metal selected from the group consisting of alkali metal, alkaline earth metal, transition metal, zinc, cadmium, tin, aluminum, double metal salts and/or mixtures of two or more thereof or a metal hydride polar bonded on the surface of said fibers and/or strands of fibers at a concentration of at least about 0.3 grams/cc of open substrate material volume, and a substantially water impermeable coating thereon.

24 Claims, No Drawings

METHODS OF MAKING PENETRATION RESISTANT COMPOSITES

CROSS-REFERENCE TO RELATED APPLICATIONS

This application is a divisional of U.S. patent application Ser. No. 11/029,685 filed Jan. 4, 2005, and now U.S. Pat. No. 7,648,757, issued on Jan. 19, 2010.

BACKGROUND OF THE INVENTION

Penetration resistant materials presently available for protecting unarmored vehicles and personnel from small arms projectile penetration or penetration from flying shrapnel and the like are relatively expensive. The compositions described herein are relatively inexpensive and cost-effective to manufacture. The materials comprise a composite which may be produced in almost any shape, size and thickness, and are fully recyclable.

SUMMARY OF THE INVENTION

The penetration resistant composites described herein comprise a substrate material comprised of woven, layered or intertwined polarized strands of glass, polyamide, polyphenylene sulfide, carbon or graphite fibers on which a selected metal, salt, oxide, hydroxide or metal hydride is polar bonded on the surface of the fibers and/or strands at concentrations sufficient to form bridges of the salt, oxide, hydroxide or hydrides between adjacent substrate strands and/or substrate fibers. Single or multiple layers of the salt or hydride bonded fibers are coated with a substantially water impermeable coating material. Panels or other shaped penetration resistant products may be produced using composite layers.

One embodiment is a method of preparing a penetration resistant composite including: providing a substrate material comprising woven, intertwined or layered polarized strands of glass, polyamide, polyphenylene sulfide, carbon or graphite fibers; bonding on the surface of said fibers and/or strands a salt, oxide, hydroxide or hydride of a metal selected from the pump consisting of alkali metal, alkaline earth metal, transition metal, zinc, cadmium, tin, aluminum, double metal salts and/or mixtures of two or more thereof to form a salt, oxide, hydroxide or hydride concentration thereon of at least about 0.3 grams/cc of open substrate volume and wherein said salt or hydride bridges adjacent strands and/or fibers; forming layers of said salt or hydride bonded substrate material; and coating separate, multiple layers, or only the exterior surface thereof with substantially water impermeable coating composition.

Another embodiment is a method of preparing a penetration resistant composite comprising: providing a substrate material comprising polarized strands of fibers; bonding a salt, oxide, hydroxide or hydride of a metal to a surface of said polarized strands of fibers to form a bonded substrate material; forming layers of the bonded substrate material; and coating the layers with a substantially water impermeable coating composition.

DETAILED DESCRIPTION OF PREFERRED EMBODIMENTS

The penetration resistant composite products described herein are fabricated from a substrate material comprising woven or intertwined polarized strands or layered strands of the substrate. Such woven or intertwined substrate material incorporate or utilize elongated or continuous fibers such as fabrics or cloth or unwoven intertwined fiber materials such as yarn, rope or the like where the fibers or strands of fibers have been twisted or formed in a coherent form such as yarn or weaves of strands. Various or different weaving patterns may be used, preferably three-dimensional weaves which yield multi-directional strength characteristics as compared to two-dimensional weaves having anisotropic strength characteristics. Moreover, the substrate utilizes elongated and/or continuous fibers or filaments as opposed to chopped or loose fibers or strands in which there is no interlocking or structural pattern to the fibrous substrate. Suitable materials also include needle woven layers of substrate fiber strands. Alternatively, layers of elongated, substantially continuous fiber strands which have not been woven in a three-dimensional weave may be used. Successive layers of the fibers are preferably positioned along different axes so as to give the substrate strength in multiple directions. Moreover, such layers of non-woven fibers can be positioned between layers of woven fibers.

The substrate material of which the fiber strands are made include glass, polyamide, polyphenylene sulfide, carbon or graphite fibers. Glass fibers are a preferred fiber material, woven glass fibers being relatively inexpensive and woven glass fiber fabric easy to handle and process in preparing the composites. The glass fibers may be E-glass and/or S-glass, the latter having a higher tensile strength. Glass fiber fabrics are also available in many different weaving patterns which also makes the glass fiber material a good candidate for the composites. Carbon and/or graphite fiber strands may also be used. Polyamide materials or nylon polymer fiber strands are also useful, having good mechanical properties. Aromatic polyamide resins (aramid resin fiber strands, commercially available as Kevlar® and Nomex®) are also useful. Yet another useful fiber strand material is made of polyphenylene sulfide, commercially available as Ryton®. Combinations of two or more of the aforesaid materials may be used in making up the substrate, with specific layered material selected to take advantage of the unique properties of each of them. The substrate material, preferably has an open volume of at least about 30%, and more preferably 50% or more, up to about 90%.

The surface of the fibers and fiber strands of the aforesaid substrate material must be polarized. Polarized fibers are commonly present on commercially available fabrics, weaves or other aforesaid forms of the substrate. If not, the substrate may be treated to polarize the fiber and strand surfaces. The surface polarization requirements of the fiber, whether provided on the substrate by a manufacturer, or whether the fibers are treated for polarization, must be sufficient to achieve a loading density of the salt on the fiber of at least about 0.3 grams per cc of open substrate volume whereby the bonded metal salt bridges adjacent fiber and/or adjacent strands of the substrate. Polarity of the substrate material may be readily determined by immersing or otherwise treating the substrate with a solution of the salt, drying the material and determining the weight of the salt polar bonded to the substrate. Alternatively, polar bonding may be determined by optically examining a sample of the dried substrate material and observing the extent of salt bridging of adjacent fiber and/or strand surfaces. Even prior to such salt bonding determination, the substrate may be examined to see if oil or lubricant is present on the surface. Oil coated material will substantially negatively affect the ability of the substrate fiber surfaces to form an ionic, polar bond with a metal salt or hydride. If surface oil is present, the substrate may be readily treated, for example, by heating the material to sufficient temperatures to burn off or evaporate the undesirable lubricant. Oil or lubricant may also be removed by treating the substrate with a solvent, and thereafter suitably drying the material to remove the solvent and dissolved lubricant. Substrates may also be treated with polarizing liquids such as water, alcohol, inorganic acids, e.g., sulfuric acid.

The substrate may be electrostatically charged by exposing the material to an electrical discharge or "corona" to improve surface polarity. Such treatment causes oxygen molecules within the discharge area to bond to the ends of molecules in the substrate material resulting in a chemically activated polar bonding surface. Again, the substrate material should be substantially free of oil prior to the electrostatic treatment.

A metal salt, metal oxide, hydroxide or metal hydride, is bonded to the surface of the polarized substrate material by impregnating, soaking, spraying, flowing, immersing or otherwise effectively exposing the substrate surface to the metal salt, oxide, hydroxide or hydride. A preferred method of bonding the salt to the substrate is by impregnating, soaking, or spraying the material with a liquid solution, slurry or suspension or mixture containing the metal salt, oxide, hydroxide or hydride followed by removing the solvent or carrier by drying, heating and/or by applying a vacuum. The substrate may also be impregnated by pumping a salt suspension, slurry or solution or liquid-salt mixture into and through the material. Where the liquid carrier is a solvent for the salt, it may be preferred to use a saturated salt solution for impregnating the substrate. However, for some cases, lower concentrations of salt may be used, for example, where necessitated or dictated to meet permissible loading densities. Where solubility of the salt in the liquid carrier is not practical or possible, substantially homogeneous dispersions may be used. Where an electrostatically charged substrate is used, the salt may be bonded by blowing or dusting the material with dry salt or hydride particle.

As previously described, it is necessary to bond a sufficient amount of metal salt, oxide, hydroxide or hydride on the substrate to achieve substantial bridging of the salt, oxide, hydroxide or hydride crystal structure between adjacent fibers and/or strands. A sufficient amount of metal salt, oxide, hydroxide or hydride is provided by at least about 0.3 grams per cc of open substrate volume, preferably at least about 0.4 grams per cc, and most preferably at least about 0.5 grams per cc of open substrate volume, which is between about 30% and about 95% of the untreated substrate volume, and preferably between about 50% and about 90%. Following the aforesaid treatment, the material is dried in equipment and under conditions to form a flat layer, or other desired size and shape using a mold or form. A dried substrate will readily hold its shape. Drying to substantially eliminate the solvent, carrier fluid or other liquid is necessary, although small amounts of fluid, for example, up to 1-2% of solvent, can be tolerated without detriment to the strength of the material. Drying and handling techniques for such solvent removal will be understood by those skilled in the art.

The metal salts, oxides or hydroxides bonded to the substrate are alkali metal, alkaline earth metal, transition metal, zinc, cadmium, tin, aluminum, double metal salts of the aforesaid metals, and/or mixtures of two or more of the metal salts. The salts of the aforesaid metals are halide, nitrite, nitrate, oxalate, perchlorate, sulfate or sulfite. The preferred salts are halides, and preferred metals are strontium, magnesium, manganese, iron, cobalt, calcium, barium and lithium. The aforesaid preferred metal salts provide molecular weight/electrovalent (ionic) bond ratios of between about 40 and about 250. Hydrides of the aforesaid metals may also be useful, examples of which are disclosed in U.S. Pat. Nos. 4,523,635 and 4,623,018, incorporated herein by reference.

Following the drying step or where the salts are bonded to dry, electrostatically charged substrate, if not previously sized, the material is cut to form layers of a desired size and/or shape, and each layer of metal salt or hydride bonded substrate material or multiple layers thereof are sealed by coating with a substantially water-impermeable composition. The coating step should be carried out under conditions or within a time so as to substantially seal the composite thereby preventing the metal salt or hydride from becoming hydrated via moisture, steam, ambient air, or the like, which may cause deterioration of strength of the material. The timing and conditions by which the coating is carried out will depend somewhat on the specific salt bonded on the substrate. For example, calcium halides, and particularly calcium chloride and calcium bromide will rapidly absorb water when exposed to atmospheric conditions causing liquefaction of the salt and/or loss of the salt bond and structural integrity of the product. Substantially water-impermeable coating compositions include epoxy resin, phenolic resin, neoprene, vinyl polymers such as PBC, PBC vinyl acetate or vinyl butyral copolymers, fluoroplastics such as polychlorotrifluoroethylene, polytetrafluoroethylene, FEP fluoroplastics, polyvinylidene fluoride, chlorinated rubber, and metal films including aluminum and zinc coatings. The aforesaid list is by way of example, and is not intended to be exhaustive. Again, the coating may be applied to individual layers of substrate, and/or to a plurality of layers or to the outer, exposed surfaces of a plurality or stack of substrate layers.

Panels or other forms and geometries such as concave, convex or round shapes of the aforesaid coated substrate composites such as laminates are formed to the desired thickness, depending on the intended ballistic protection desired, in combination with the aforesaid composites to further achieve desired or necessary performance characteristics. For example, useful panels or laminates of such salt bonded woven substrates may comprise 10-50 layers per inch thickness. Such panels or laminates may be installed in doors, sides, bottoms or tops of a vehicle to provide armor and projectile protection. The panels may also be assembled in the form of cases, cylinders, boxes or containers for protection of many kinds of ordnance or other valuable and/or fragile material such as ammunition, fuel and missiles as well as personnel. Laminates may include layers of steel or other ballistic resistant material such as carbon fiber composites, aramid composites or metal alloys.

By way of example, a woven glass fiber substrate bonded with strontium chloride was formed according to the previously described procedure at a concentration of 0.5 grams salt per cc of open substrate space. Layers of the substrate were coated with epoxy resin and formed in a panel 12.5 in.×12.5 in.×0.5 in. thick. The panel weighed 4.71 pounds, having material density of 0.06 pounds per cubic inch, comparing to 22% of the density of carbon steel. Bullets fired from a military-issued Berretta gun firing 9 mm 124-grain FMG bullets (9 g PMC stock number, full metal jacket), at 20 yards did not fully penetrate the panel.

What is claimed is:

1. A method of preparing a penetration resistant composite comprising:

providing a substrate material comprising woven, intertwined or layered polarized strands of glass, polyamide, polyphenylene sulfide, carbon or graphite fibers;

applying to said fibers and/or strands a salt, oxide, hydroxide or hydride of a metal selected from the group consisting of alkali metal, alkaline earth metal, transition metal, zinc, cadmium, tin, aluminum, double metal salts and/or mixtures of two or more thereof to form a salt, oxide, hydroxide or hydride concentration thereon of at least about 0.3 grams/cc of open substrate volume and wherein said salt, oxide, hydroxide or hydride bridges adjacent strands and/or fibers;

forming one or more layers of said substrate material; and coating separate layers, multiple layers, or only the exterior surface thereof with substantially water impermeable coating composition.

2. A method of claim 1 wherein the application comprises impregnating said metal salt, oxide, hydroxide or hydride on said substrate material.

3. A method of claim 1 wherein said metal salt, oxide, hydroxide or hydride is applied to said substrate by soaking, spraying, flowing, immersing and/or impregnating said substrate with a liquid composition thereof.

4. A method of claim 3 including drying said substrate to substantially remove liquid therefrom prior to said coating thereof.

5. A method of claim 4 comprising substantially preventing hydration of said dried substrate prior to coating thereof with said substantially water impermeable coating composition.

6. A method of claim 1 wherein said substrate material is treated to create an electrostatic charge of fibers and/or strands thereof and wherein said metal salt, oxide, hydroxide or hydride is applied to the surface of said fibers and/or strands by dusting or dry spraying the salt, oxide, hydroxide or hydride on said substrate material.

7. A method of preparing a penetration resistant composite comprising:

providing a substrate material comprising polarized strands of fibers;

applying a salt, oxide, hydroxide or hydride of a metal to a said polarized strands of fibers to form a bonded substrate material;

forming a composite comprising one or more layers of the bonded substrate material; and coating the layers with a substantially water impermeable coating composition.

8. A method of claim 7, wherein the polarized strands of fibers comprise glass, polyamide, polyphenylene sulfide, carbon or graphite fibers.

9. A method of claim 7, wherein the polarized strands of fibers comprise woven, intertwined or layered strands of fibers.

10. A method of claim 7, wherein the metal is selected from the group consisting of alkali metal, alkaline earth metal, transition metal, zinc, cadmium, tin, aluminum, and double metal salts.

11. A method of claim 7, wherein the metal comprises a mixture of two or more of mixtures of two or more alkali metal, alkaline earth metal, transition metal, zinc, cadmium, tin, aluminum, and double metal salts.

12. A method of claim 7, comprising applying a salt, oxide, hydroxide or hydride of a metal to the substrate material to form a concentration of salt, oxide, hydroxide or hydride of a metal of at least about 0.3 grams/cc of open substrate volume.

13. A method of claim 7, wherein the salt, oxide, hydroxide or hydride of a metal bridges adjacent strands of the polarized fibers.

14. A method of claim 7, comprising impregnating said salt, oxide, hydroxide or hydride of a metal on said substrate material.

15. A method of claim 7 wherein said salt, oxide, hydroxide or hydride of a metal is applied to said substrate by soaking, spraying, flowing, immersing and/or impregnating said substrate with a liquid composition of said salt, oxide, hydroxide or hydride of a metal.

16. A method of claim 15, further comprising drying said substrate to substantially remove liquid therefrom prior to said coating.

17. A method of claim 16, wherein coating separate, multiple layers, or only an exterior surface of the bonded substrate material with a substantially water impermeable coating composition prevents hydration of said substrate.

18. A method of claim 7 wherein said substrate material is treated to create an electrostatic charge of fibers prior to applying the metal salt, oxide, hydroxide or hydride.

19. A method of claim 7, wherein said substrate material is treated by dusting or dry spraying said salt, oxide, hydroxide or hydride of a metal thereon.

20. A method of claim 7, wherein coating the layers comprises coating separate layers, multiple layers, or only an exterior surface of the bonded substrate material.

21. A method of claim 7, wherein the water impermeable coating comprises epoxy resin, phenolic resin, neoprene, vinyl polymers, fluoroplastics, polyvinylidene fluoride, chlorinated rubber, or metal film.

22. A method of claim 7, comprising a plurality of layers of woven or intertwined polarized strands of fibers.

23. A method of claim 7, wherein the polarized strands comprise aromatic polyamide resin fibers.

24. A method of claim 7, wherein the polarized strands comprise combinations of two or more different polarized strand materials.

* * * * *